US005287590A

United States Patent [19]

Yonkers et al.

[11] Patent Number: 5,287,590

[45] Date of Patent: Feb. 22, 1994

[54] WET VACUUM/EXTRACTOR WITH VACUUM PRIMING SYSTEM

[76] Inventors: Robert A. Yonkers, 3565 Apache Ct., Grandville, Mich. 49418; Richard L. Norwood, 100 W. Division St.; Jonathan L. Miner, 50 S. Lincoln St., both of, Rockford, Mich. 49341

[21] Appl. No.: 939,320

[22] Filed: Sep. 2, 1992

[51] Int. Cl.[5] ..... A47L 7/00

[52] U.S. Cl. ..... 15/321; 15/353; 417/199.2

[58] Field of Search ..... 15/320, 321, 322; 417/199.2

[56] References Cited

U.S. PATENT DOCUMENTS

| | | | |
|---|---|---|---|
| Re. 26,950 | 9/1970 | Hays | 15/321 |
| 2,293,722 | 8/1942 | Erickson | 15/320 |
| 2,333,829 | 11/1943 | Terry | 15/320 |
| 2,334,914 | 11/1943 | Erickson | 15/320 |
| 2,575,675 | 11/1951 | Morgan | 15/320 X |
| 3,072,950 | 1/1963 | Duff et al. | 15/320 |
| 3,343,199 | 9/1967 | Nolte | 15/321 |
| 3,896,521 | 7/1975 | Parise | 15/321 |
| 3,939,515 | 2/1976 | Platek | 15/321 |
| 4,067,663 | 1/1978 | Brooks et al. | 417/199.2 |
| 4,123,818 | 11/1978 | Hurwitz | 15/321 |
| 4,138,760 | 2/1979 | Cadle | 15/321 |
| 4,185,354 | 1/1980 | Brazier | 15/321 |
| 4,210,978 | 7/1980 | Johnson et al. | 15/320 |
| 4,216,563 | 8/1980 | Cyphert | 15/321 |
| 4,218,805 | 8/1980 | Brazier | 15/321 |
| 4,287,636 | 9/1981 | Brazier | 15/321 |
| 4,314,385 | 2/1982 | Wimsatt et al. | 15/321 |
| 4,329,756 | 5/1982 | Chicoine et al. | 15/321 |
| 4,353,145 | 10/1982 | Woodford | 15/321 |
| 4,829,624 | 5/1989 | Lackner et al. | 15/320 |
| 4,864,680 | 9/1989 | Blase et al. | 15/321 |
| 5,189,755 | 3/1993 | Yonkers et al. | 15/321 |

FOREIGN PATENT DOCUMENTS

| | | |
|---|---|---|
| 325737 | 2/1930 | United Kingdom . |
| 776514 | 6/1957 | United Kingdom . |
| 804390 | 11/1958 | United Kingdom . |
| 2038168 | 7/1980 | United Kingdom . |
| 1601456 | 10/1981 | United Kingdom . |
| 1602918 | 11/1981 | United Kingdom . |
| 1602919 | 11/1981 | United Kingdom . |
| 2247831 | 3/1992 | United Kingdom . |
| 2259336 | 3/1993 | United Kingdom . |

*Primary Examiner*—Chris K. Moore

*Attorney, Agent, or Firm*—Price, Heneveld, Cooper, DeWitt & Litton

[57] ABSTRACT

A wet vacuum/extractor having a first cleaning solution line which extends from a cleaning solution tank to a non-self-priming pump and a second cleaning solution line which extends from the pump to a normally closed fluid flow control valve which controls the flow of liquid on to the cleaning head. The vacuum priming system of the present invention opens the second cleaning solution line to the vacuum generated between the cleaning head and the vacuum fan. This vacuum beyond the output of the pump draws solution from the solution tank into the operating pump. Once the pump is thus primed, the second cleaning solution line is closed to the vacuum and the pump now pumps the solution past the closed fluid flow control valve to the cleaning head.

47 Claims, 5 Drawing Sheets

WET VACUUM/EXTRACTOR WITH VACUUM PRIMING SYSTEM

BACKGROUND OF THE INVENTION

The present invention relates to surface cleaning extractors and wet vacuums. Such extractors are devices which apply a cleaning solution to a surface, such as carpet, upholstery and the like, and then vacuum the solution from the surface, extracting dirt and debris from the surface. Such extractors sometimes use built-in solution tanks and sometimes include attachment means with a long hose so the unit can obtain water from a faucet.

When a built-in solution tank is used, some means for pumping the solution from the tank to a cleaning tool is required. Such pumping function is typically accomplished by an electric pump which draws the solution from the tank and delivers it to the cleaning tool. Often times such pumps are expensive, self-priming units. Alternatively, such pumps can be non-self-priming and positioned such that gravity feeds the solution from the tank to the pump for priming purposes. While non-self-priming pumps are attractive from a cost perspective, their dependence upon gravity to move the solution from the tank makes them less attractive. The self-priming units are, of course, attractive, but their expense makes them unattractive for inclusion on a lower cost extractor. Therefore, there is a need to solve this problem of more easily priming an inexpensive non-self-priming pump.

SUMMARY OF THE INVENTION

In the extractor of the present invention, a non-self-priming pump is primed by temporarily opening the cleaning solution line, which extends from the pump to the cleaning tool, by a vacuum access valve to the vacuum generated between the cleaning head and the vacuum fan. This vacuum applied beyond the output of the pump draws solution from the solution tank into the operating pump, which then pumps solution to the vacuum access valve. Once the pump is thus primed, the cleaning solution line is closed to the vacuum so the pump can now pump the solution past the normally closed fluid flow control valve to the cleaning head.

In an alternative embodiment, the cleaning solution line is normally open to the vacuum generated in the cleaning tool, which extends from the cleaning head to the vacuum fan, by a vacuum access valve. The vacuum applied beyond the output of the pump draws solution from the solution tank into the operating pump, which then pumps solution to the vacuum access valve. Once the pump is thus primed, the cleaning solution line is closed to the vacuum so the pump can now pump the solution past the normally closed fluid flow control valve to the cleaning head.

A BRIEF DESCRIPTION OF DRAWINGS

DETAILED DESCRIPTION OF THE PREFERRED EMBODIMENT

Figure 1:
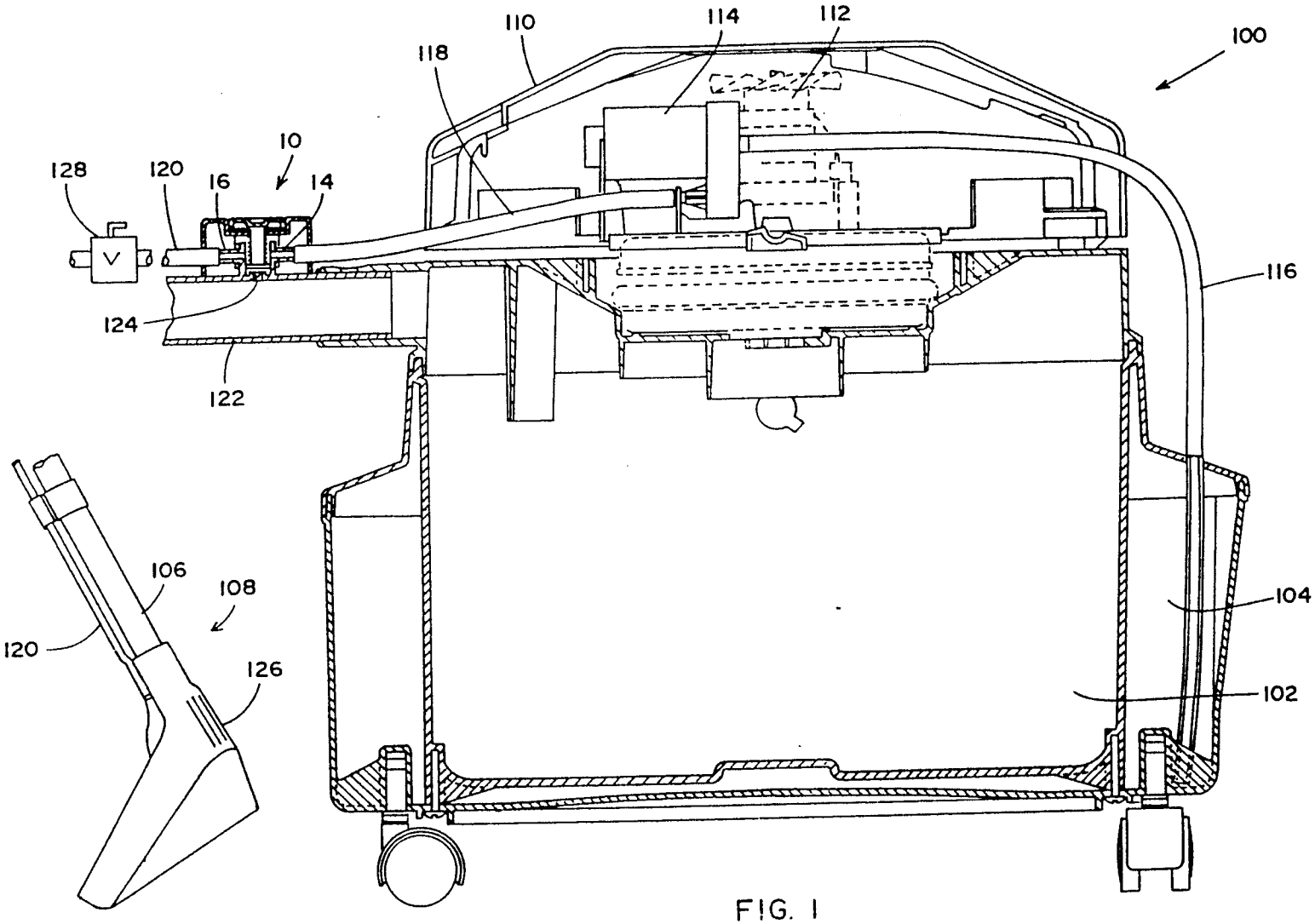
FIG. 1 is a sectional view of the wet vacuum/extractor and vacuum priming system of the present invention along with a schematic fluid flow control valve and a portion of a wand handle and cleaning head.

In the preferred embodiment, a vacuum access valve 10 of the present invention is shown in conjunction with a wet vacuum/extractor 100 and a cleaning tool 108 (FIG. 1). The extractor 100 includes a recovery tank 102, a solution tank 104, a suction conduit 122, upon which vacuum access valve 10 is positioned, and a housing 110. A conventional vacuum fan 112 is located within the housing 110 as is a non-self-priming pump 114. A first solution feed line 116 connects solution tank 104 with pump 114 and a second solution feed line 118 connects pump 114 with vacuum access valve 10 through a solution entry conduit 14. A third solution feed life 120 connects the vacuum access valve 10 through a solution exit conduit 16 with a normally closed fluid flow control valve 128 which controls the flow of fluid to the cleaning head 126 of tool 108. A suction hose, not shown, connects suction wand 106 with suction conduit 122 and recovery tank 102.

Vacuum access valve 10 is preferably fabricated as a part of suction conduit 122. Valve 10 may also be fabricated separately and attached to suction conduit 122. Valve 10 may itself be located in housing 110 and/or may operatively connect to the vacuum generated by vacuum fan 112 at any point in the vacuum flow path which connects cleaning tool 108 to vacuum fan 112. In other words, valve 10 could access the vacuum in recovery tank 102, in suction conduit 122 or even at cleaning tool 108, though the best modes contemplated would be connection to suction conduit 122 or recovery tank 102.

Figure 2:
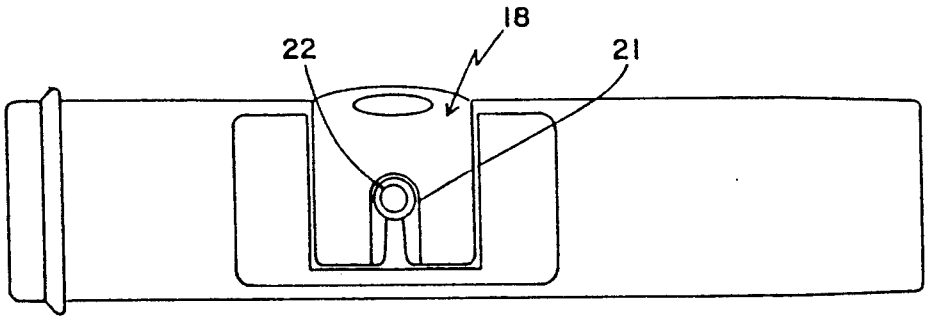
FIG. 2 is a plan view of the vacuum priming valve of the present invention.
Figure 3:
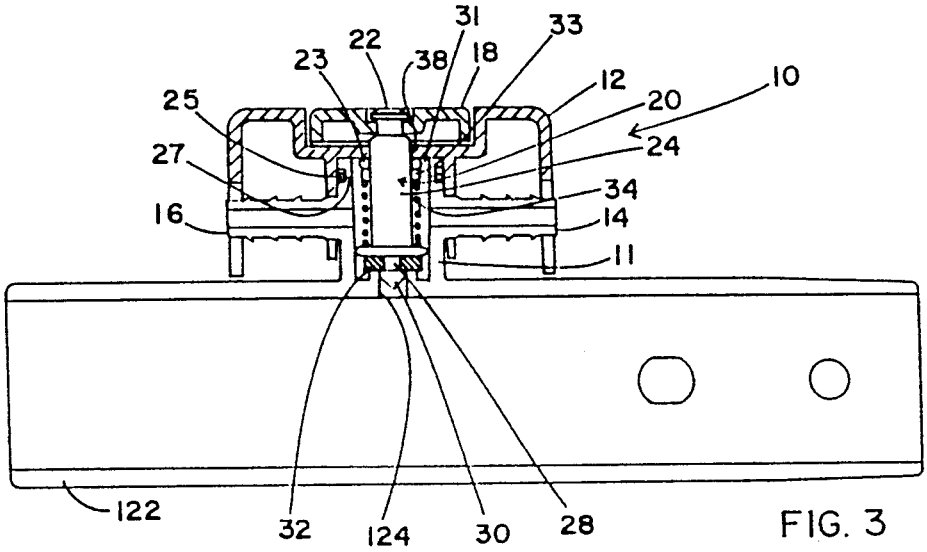
FIG. 3 is a side sectional detail of the vacuum priming valve of the present invention.

In the first preferred embodiment as shown in FIGS. 1–5, valve 10 consists of a valve body 11, which is fabricated as a part of suction conduit 122, and an inverted cup-like housing 12 having an opening in each side, an operating lever 18, a plunger 20, a ring 33 coaxial with the plunger 20, a first 0-ring 23, a second 0-ring 25, a gasket 32 and a biasing spring 34 (see especially FIG. 3).

In the preferred embodiment, valve 10 has an aperture 124 providing access to the pressure drop present in suction conduit 122. Plunger 20 consists of a plunger head 22 located atop a plunger body 24, a gasket collar 26 located at the base of plunger body 24, a shaft 28 extending from gasket collar 26, and an aligning cone 30 at the tip of shaft 28. During assembly of valve 10, aligning cone 20 is placed in aperture 124 to properly position plunger 20 within valve body 11. During positioning, gasket 32 is pinched between gasket collar 26 and a valve seat 36 located atop aperture 124. Biasing spring 34 is then slipped over plunger 20 and is seated on collar 26 opposite gasket 32. Ring 33 is then fitted over plunger 20 on top of spring 34 followed by first 0-ring 23.

Figure 4:
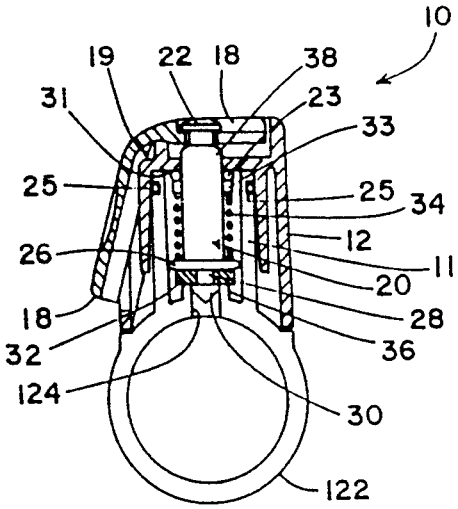
FIG. 4 is a front sectional detail of the valve of the vacuum priming system in the closed position.

Prior to snapping housing 12 onto valve body 11, a second O-ring 25 is fitted into a circumferential notch 27 on the surface of valve body 11. Attachment of housing 12 onto valve body 11 pinches second 0-ring 25 between notch 27 of valve body 11 and housing 12 and compresses spring 34 so that it biases first 0-ring 23 into contact with a land area 31 of upper housing 12 and ring 33. 0-rings 23 and 25 prevent the flow of air or liquid from valve 10 to the atmosphere or the flow of air or liquid from the atmosphere into valve 10 thus providing an airtight and liquid tight seal between housing 12 and valve body 11. Upper housing 12 contains an aperture 38 through which plunger head 22 and a portion of plunger 20 project. Lever 18 is connected to plunger head 22 by clip 21 integrally formed on the end of lever 18 (FIG. 2). Lever 18 is positioned on a fulcrum 19 located on the top portion of upper housing 12 (FIG. 4).

In operation, vacuum fan 112 pulls a vacuum which creates a pressure drop from the head of cleaning tool 108 through suction conduit 122 and into recovery tank 102. Vacuum access valve 10 allows this pressure drop to be used to prime pump 114 by pulling solution from solution tank 104 through first solution feed line 116 to pump 114 while the pump is operating.

Valve 10 gains access to the pressure drop present in suction conduit 122 through aperture 124 (FIGS. 1, 3, 4 and 5). This access is regulated by the interaction of the components of valve 10, including a solution entry conduit 14, a solution exit conduit 16, operating lever 18, plunger 20, gasket 32 and biasing spring 34. Movement of lever 18 from a first position shown in FIG. 4 to a second position shown in FIG. 5 causes plunger 20 to move vertically upward causing the gasket 32 to be removed from valve seat 36. The air present in valve 10, pump 114 and solution lines 116, 118 and 120, then becomes subjected to the vacuum present in suction conduit 122 through aperture 124. Biasing spring 34, which is fitted between gasket collar 26 and land area 31, becomes compressed due to the upward movement of the plunger 20 and returns the plunger 20 to the original closed position upon release of lever 18.

When valve 10 is closed, aligning cone 30 is located within aperture 124 and gasket 32 abuts valve seat 36 located atop aperture 124 to seal aperture 124. At least some clearance between gasket collar 26 and the interior of valve 10 is necessary so that gasket collar 26 does not act to seal valve 10 from the pressure drop present in suction conduit 122. Biasing spring 34 performs three functions during the operation of valve 10. When valve 10 is closed, spring 34 is biased sufficiently to close off access to the pressure drop in suction conduit 122 and to compress first O-ring 23 so that a liquid and airtight seal is achieved. In addition, spring 34 biases the operating lever 18 outwardly so that following actuation of lever 18, lever 18 is automatically returned to the first position.

Figure 5:
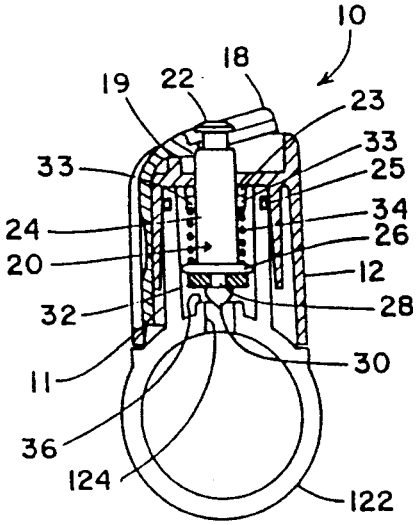
FIG. 5 is a front sectional detail of the valve of the vacuum priming system in the open position.

In a more specific explanation, access to the pressure drop created in suction conduit 122 by vacuum fan 112 is obtained by moving lever 18 from its first position shown in FIG. 4 to its second position shown in FIG. 5. This movement causes plunger 20 to be moved vertically which removes gasket 32 from valve seat 36. First 0-ring 23, biased by spring 34, prevents the pressure drop from leaking out of valve 10. The pressure drop then travels through solution feed lines 118 and 116 to reach solution tank 104. The pressure drop causes the solution present there to flow through solution feed line 116 to pump 114 which is operating. Priming of the pump 114 is then effected.

Following priming of pump 114, and until lever 18 is released, the solution then flows through solution feed line 118 to barbed solution entry conduit 14, through valve 10 and into aperture 124, into suction conduit 122, and deposited into tank 102. Once lever 18 is released the primed pump 114 will pump solution through the barbed solution exit conduit 16 and solution feed line 120 to cleaning head 126. Fluid flow control valve 128 enables the operator of the extractor to control the flow of cleaning solution to the surface being cleaned. The valve 128 is normally closed which enables vacuum access valve 10 to draw cleaning solution upward into operating liquid pump 114. If the extractor is turned off, the valve 128 prevents the cleaning solution from siphoning out of the liquid pump 114, thus maintaining the pump prime. In one embodiment, the fluid flow control valve 128 can be connected with pump 114 whereby fluid flow control valve 128 simultaneously opens or closes fluid flow line 120 and starts or stops pump 114, respectively.

Figure 8:
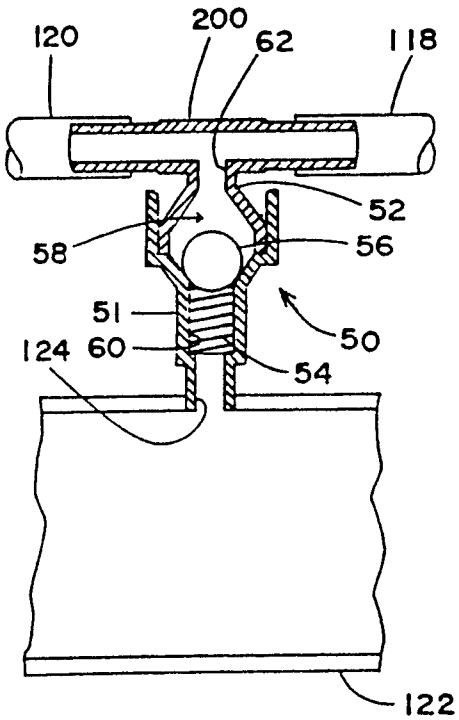
FIG. 8 is a sectional view of the second embodiment of the vacuum priming system of the present invention in the operating position.
Figure 7:
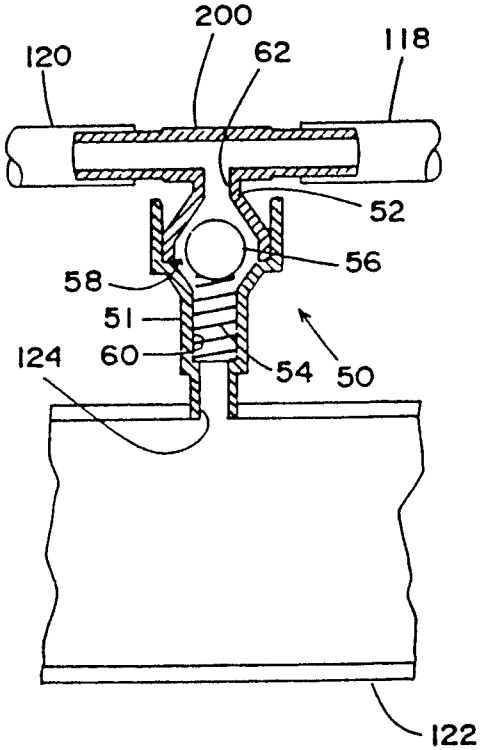
FIG. 7 is a sectional view of the second embodiment of the vacuum priming system in the priming position.
Figure 6:
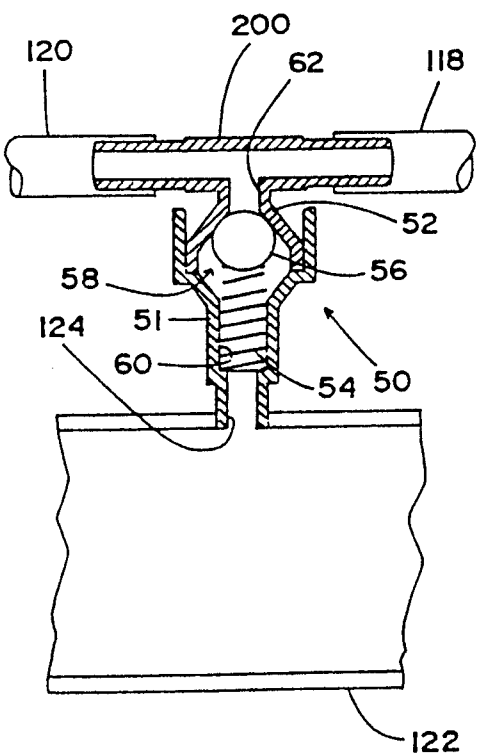
FIG. 6 is a sectional view of a second embodiment of the vacuum priming system of the present invention in the closed position.

In a second embodiment shown in FIGS. 6, 7 and 8, vacuum access valve 50 also accesses the pressure drop present in suction conduit 122 through aperture 124. This access is regulated by the interaction of the components of valve 50 which include a Y-shaped valve member 51 fabricated as a part of suction conduit 122, an inverted V-shaped valve insert 52 fabricated as a part of a cleaning solution conduit 200 which connects second solution line 118 and third solution line 120, a valve spring 54 and a valve ball 56. A valve ball chamber 58 is formed by positioning valve insert 52 in valve member 51. The stem of Y-shaped valve member 51 is a cylinder 60 which is sized to receive valve spring 54. Valve ball 56 is positioned within valve ball chamber 58 and on top of valve spring 54. Solution conduit 200 accesses valve ball chamber 58 through a first valve aperture 62 while valve ball chamber 58 accesses suction conduit 122 through conduit aperture 124. In static position, spring 54 is tensioned to bias ball 56 into sealing engagement with aperture 62, thus closing off the aperture (FIG. 6).

In operation, vacuum fan 112 pulls a vacuum which creates a pressure drop from the head of cleaning tool 108 through suction conduit 122 and into recovery tank 102. Liquid control valve 128 (FIG. 1) is also used with the second embodiment of the vacuum access valve. Vacuum access valve 50 allows this pressure drop to be used to overcome the bias provided by spring 54 and to move ball 56 from aperture 62 to a neutral position within valve ball chamber 58 between aperture 62 and the point of intersection of valve ball chamber 58 and cylinder 60 (FIG. 7). This allows the vacuum to draw liquid from solution tank 104 through solution feed line 116 to pump 114. Priming of the pump 114 is then effected.

Following priming of pump 114, the solution then flows through solution feed line 118 to solution conduit 200. In solution conduit 200 a portion of the solution enters valve ball chamber 58 and the remainder flows through solution feed line 120 to cleaning head 126. With pump 114 primed and pumping, the density of the solution and the increase in line pressure from the pump 114 overcomes the bias force of spring 54 and causes ball 56 to seat at the point of intersection of valve ball chamber 58 and cylinder 60 and thus to block the vacuum passage through conduit aperture 124 and cylinder 60 (FIG. 8). The relative dimensions of ball 56 and valve ball chamber 58 must be such that ball 56 is small enough to allow passage of airflow around it while located in the neutral position in valve ball chamber 58, but also large enough to block vacuum passage and fluid passage through conduit aperture 124 when seated at the point of intersection of valve ball chamber 58 and cylinder 60.

Figure 9:
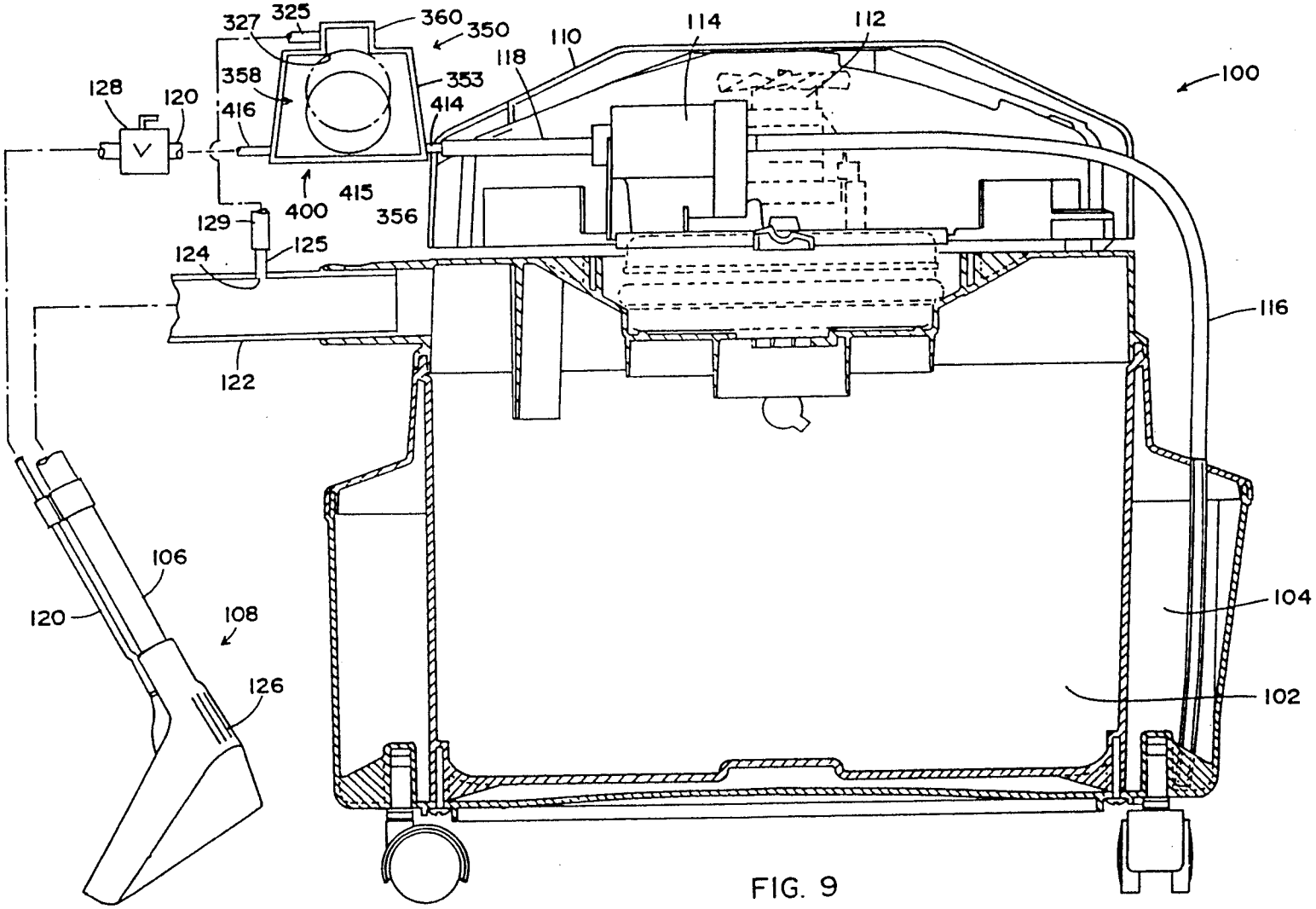
FIG. 9 is a sectional view of a third embodiment of the wet vacuum/extractor and vacuum priming system of the present invention along with a schematic fluid flow control valve and a portion of a wand handle and cleaning head.
Figure 10:
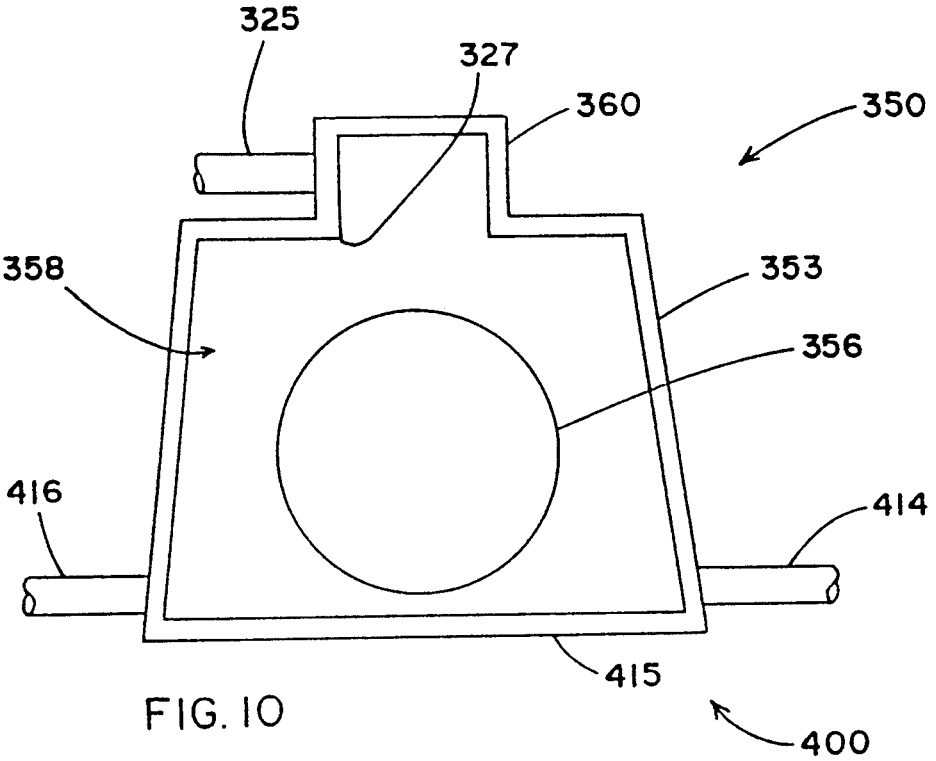
FIG. 10 is a sectional view of the third embodiment of the vacuum priming system of the present invention in the operating and priming position.
Figure 11:
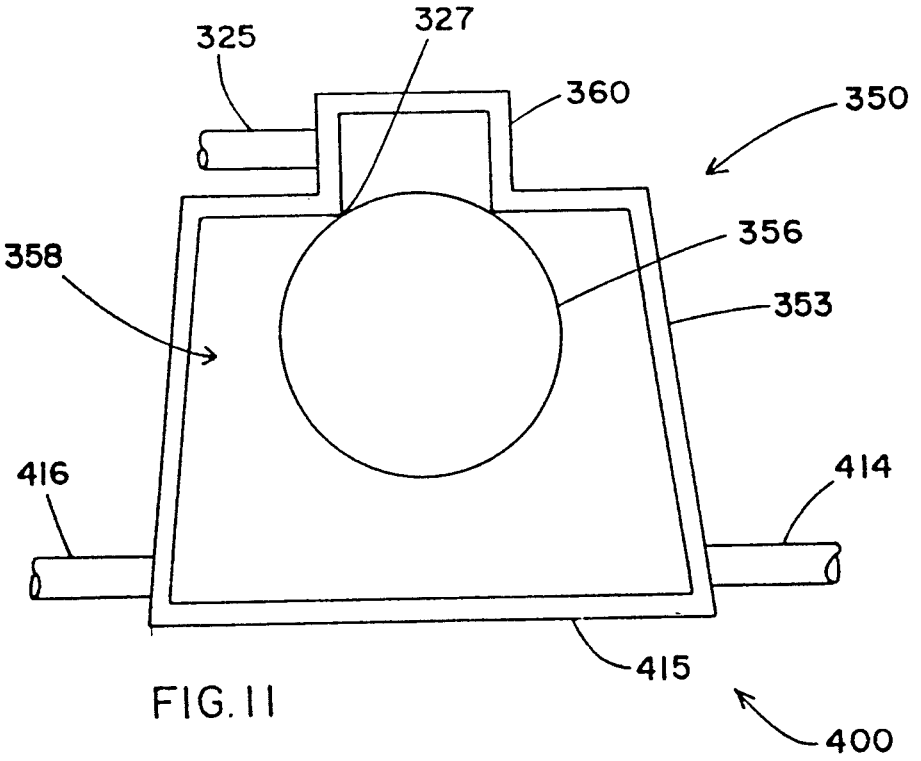
FIG. 11 is a sectional view of the third embodiment of the vacuum priming system of the present invention in the closed position.

In a third embodiment, a vacuum access valve 350 of the present invention is shown in conjunction with a wet vacuum/extractor 100 and a cleaning tool 108 (FIG. 9). The extractor 100 is the same in all respects as shown in FIG. 1 except that vacuum access valve 350 is positioned adjacent to housing 110 above suction conduit 122 and at the same level or above pump 114. Alternatively, access valve 350 can be within housing 110 because it is automatic, i.e., no actuation is needed by the user. Valve 350 includes an inverted cup-like valve body 353, a cylinder 360 in fluid communication with and fitted on top of said valve body 353, a vacuum access member 325 in fluid communication with and attached to said cylinder 360, a valve ball 356 and a valve bottom 400. Valve bottom 400, which consists of a solution entry conduit 414, bottom plate 415 and a solution exit conduit 416, connects second solution line 118 and third solution line 120. Valve ball 356 is contained within a valve ball chamber 358 which is formed by positioning valve body 353 in dish-like container 415.

An aperture 327, which is formed at the intersection between valve body 353 and cylinder 360 is sized to be blocked by valve ball 356. Valve 350 obtains access to the vacuum present in suction conduit 122 by means of a vacuum connector 129 which connects vacuum access member 325 with a vacuum conduit 125 which projects from suction conduit 122. Also, connector 129 may go directly to waste water tank 102 if valve 350 is within housing 110. Access to the vacuum present in suction conduit 122 is obtained through aperture 124. In valve 350, access to the vacuum is regulated by the interaction of valve ball 356 and aperture 327. In static position, valve ball 356 rests in position on bottom plate 415.

In operation, vacuum fan 112 pulls a vacuum which creates a pressure drop from the head of cleaning tool 108 through suction conduit 122 and into recovery tank 102. Liquid control valve 128 (FIG. 1) is also used with the third embodiment of the vacuum access valve. A pressure drop is also created within vacuum access valve 350 because of its access to suction conduit 122 or tank 102 through vacuum connector 129. This pressure drop is used to draw liquid from solution tank 104 through solution feed line 116 to pump 114. Priming of the pump 114 is then effected. Following priming of pump 114, the solution then flows through solution feed line 118 to solution conduit 414. In solution conduit 414, the solution enters valve chamber 358 and fills the chamber until valve ball 356 floats up and closes aperture 327, thus stopping the vacuum passage through vacuum access member 325 (FIG. 12). Then, the solution flows through solution feed line 120 to cleaning head 126.

The relative dimensions of ball 356 and chamber 358 are such that ball 356 is small enough to allow passage of airflow and liquid around it while located in the neutral position in dish-like container 415, but also large enough to stop vacuum passage through vacuum access member 325 when positioned at the point of intersection of chamber 358 and cylinder 360, aperture 327.

The above description is considered that of the preferred embodiment only. Modifications of the invention will occur to those who make or use the invention. Therefore, it is understood that the embodiment shown in the drawings and described above is merely for illustrative purposes and is not intended to limit the scope of the invention, which is defined by the following claims as interpreted according to the principles of patent law.

The embodiments of the invention in which an exclusive property or privilege is claimed are defined as follows.

1. A wet vacuum/extractor comprising:
(a) a vacuum fan for generating a vacuum;
(b) a cleaning solution tank;
(c) a cleaning tool and vacuum flow path defining means operably connecting said cleaning tool to said vacuum fan whereby debris and liquid can be removed from a surface to be cleaned through said cleaning tool;
(d) a non-self-priming pump operatively connected with said cleaning solution tank for pumping cleaning solution from said tank to said cleaning tool;
(e) a fluid flow line extending from said pump to said cleaning tool to deliver cleaning solution from said tank to said cleaning tool; and
(f) valve means for switchably connecting said fluid flow line to said vacuum flow path means whereby said vacuum causes said cleaning solution to flow from said tank through said non-self-priming pump to prime said pump.

2. A wet vacuum/extractor in accordance with claim 1 wherein said valve means includes a moveable member moveable between a first position blocking communication between said fluid flow line and said vacuum flow path means and a second position wherein said fluid flow line is in communication with said vacuum flow path means.

3. A wet vacuum/extractor in accordance with claim 2 wherein said valve means has a bias means for normally biasing said moveable member toward said first position.

4. A wet vacuum/extractor in accordance with claim 3 wherein said valve means has an actuator for counteracting said bias means to move said moveable member from said first position to said second position to provide communication between said fluid flow line and said vacuum flow path means.

5. A wet vacuum/extractor in accordance with claim 4 wherein said moveable member is a plunger and said plunger has a gasket for blocking said communication between said fluid flow line and said vacuum flow path means in said first position.

6. A wet vacuum/extractor in accordance with claim 5 wherein said bias means is a spring.

7. A wet vacuum/extractor in accordance with claim 1 wherein said valve means has an inlet connected to said fluid flow line and an outlet connected to said vacuum flow path means and includes a moveable member in said valve means moveable from a first position blocking said inlet to a second position wherein said fluid flow line is in communication with said vacuum flow path means and a third position blocking said outlet to said vacuum flow path means.

8. A wet vacuum/extractor in accordance with claim 7 wherein said valve means has a bias means for biasing said moveable member toward said first position.

9. A wet vacuum/extractor in accordance with claim 8 wherein said moveable member is a ball.

10. A wet vacuum/extractor in accordance with claim 9 wherein said bias means is a spring.

11. A wet vacuum/extractor in accordance with claim 10 wherein said valve means is a chamber whose relative dimension to said ball, said inlet and said outlet is such that said ball is small enough to allow passage of airflow around it while in said second position, but large enough to block said inlet connected to said fluid flow line and large enough to block said outlet to said vacuum flow path means.

12. A wet vacuum/extractor in accordance with claim 11 wherein said ball is moved from said first position to said second position by a pressure drop created by said vacuum.

13. A wet vacuum/extractor in accordance with claim 12 wherein said ball is moved from said second position to said third position by the density of the cleaning solution and the increase in line pressure from the pump.

14. A wet vacuum/extractor in accordance with claim 1 wherein said valve means has an inlet connected to said fluid flow line and an outlet connected to said vacuum flow path means and includes a moveable member in said valve means moveable from a first position wherein said fluid flow line is in communication with said vacuum flow path means and a second position blocking said outlet to said vacuum flow path means.

15. A wet vacuum/extractor in accordance with claim 14 wherein said moveable member is biased toward said first position.

16. A wet vacuum/extractor in accordance with claim 15 wherein said moveable member is a ball.

17. A wet vacuum/extractor in accordance with claim 16 wherein said valve means includes an inlet fluid line and an outlet fluid line.

18. A wet vacuum/extractor in accordance with claim 17 wherein a vacuum connector connects said vacuum flow path means to an opening in said valve means.

19. A wet vacuum/extractor in accordance with claim 18 wherein said valve means is a chamber whose relative dimension to said ball and said outlet is such that said ball is small enough to allow passage of airflow around it while in said second position but large enough to block said outlet to said vacuum flow path means.

20. A wet vacuum/extractor in accordance with claim 19 wherein said ball in said chamber is biased toward said first position by the force of gravity.

21. A wet vacuum/extractor in accordance with claim 20 wherein said ball is moved from said first position to said second position by the buoyancy and density of the cleaning solution and/or the increase in line pressure from the pump.

22. A wet vacuum/extractor comprising:

(a) a vacuum fan for generating a vacuum;

(b) a cleaning solution tank;

(c) a cleaning tool and vacuum flow path defining means operably connecting said tool to said vacuum fan whereby debris and liquid can be removed from a surface to be cleaned through said cleaning tool;

(d) a non-self-priming pump operatively connected with said cleaning solution tank for pumping cleaning solution from said tank to said cleaning tool;

(e) a fluid flow line extending from said pump to said cleaning tool to deliver cleaning solution from said tank to said cleaning tool;

(f) a first valve means for controlling the flow of fluid to said cleaning tool; and (g) a second valve means for switchably connecting said fluid flow line to said vacuum flow path means whereby when said first valve means is closed said second valve means causes cleaning solution to flow from said tank through said non-self-printing pump to prime said pump.

23. A wet vacuum/extractor in accordance with claim 22 wherein said second valve means has a bias means for biasing said moveable member toward said first position.

24. A wet vacuum/extractor in accordance with claim 23 wherein said second valve means has an actuator for counteracting said bias means and positioning said moveable member in said second position.

25. A wet vacuum/extractor in accordance with claim 24 wherein said moveable member is a plunger and said plunger has a gasket for blocking said communication between said fluid flow line and said vacuum flow path means.

26. A wet vacuum/extractor in accordance with claim 25 wherein said bias means is a spring.

27. A wet vacuum/extractor in accordance with claim 22 wherein said second valve means has an inlet and an outlet and has a moveable member in said second valve means moveable from a first position blocking said inlet, a second position wherein said fluid flow line is in communication with said vacuum flow path means and a third position blocking said outlet to said vacuum flow path means.

28. A wet vacuum/extractor in accordance with claim 27 wherein said second valve means has a bias means for biasing said moveable member toward said first position.

29. A wet vacuum/extractor in accordance with claim 28 wherein said moveable member is a ball.

30. A wet vacuum/extractor in accordance with claim 29 wherein said bias means is a spring.

31. A wet vacuum/extractor in accordance with claim 22 wherein said second valve means has an inlet and an outlet and has a moveable member in said second valve means moveable from a first position wherein said fluid flow line is in fluid communication with said vacuum flow path means and a second position wherein said fluid communication between said fluid flow line and said vacuum flow path means is blocked.

32. A wet vacuum/extractor in accordance with claim 31 wherein said moveable member is biased toward said first position.

33. A wet vacuum/extractor in accordance with claim 32 wherein said moveable member is a ball.

34. A method for priming a non-self-priming pump on a wet vacuum/extractor which includes a vacuum fan for generating a vacuum, a cleaning solution tank, a cleaning tool, vacuum flow path defining means operably connecting said tool to said vacuum fan whereby said vacuum fan can generate said vacuum in said cleaning tool, a non-self-priming pump, a cleaning solution feed line extending from said cleaning solution tank to said pump, a fluid flow line extending from said pump to said cleaning tool, said method comprising the following steps:

(a) generating a vacuum with said vacuum fan;

(b) providing a valve means operatively connecting said fluid flow line and said vacuum flow path means for switchably connecting said fluid flow line with said vacuum flow path means;

(c) opening said valve means to operatively connect said fluid flow line with said vacuum flow path means;

(d) using said vacuum to cause cleaning solution to flow from said cleaning solution tank to said pump via said cleaning solution line to thereby prime said pump with said cleaning solution; and (e) closing said valve means after said pump is primed, whereby is pumped to said cleaning tool from said tank via said fluid flow line.

35. A method in accordance with claim 34 wherein generating a vacuum with said vacuum fan automatically opens said valve means.

36. A method in accordance with claim 35 wherein pumping said cleaning solution pumped through said fluid flow line past said valve means automatically closes said valve means.

37. A method in accordance with claim 36 wherein said valve means is manually opened to operably connect said fluid flow line with said vacuum flow path means.

38. A method in accordance with claim 37 wherein said manually opened valve means has a bias means for biasing said valve means to a closed position.

39. A method for priming a non-self-priming pump on wet vacuum/extractor which includes a vacuum fan for generating a vacuum, a cleaning solution tank, a cleaning tool, vacuum flow path defining means operably connecting said tool to said vacuum fan whereby said vacuum fan can generate said vacuum in said cleaning tool, a non-self-priming pump, a cleaning solution feed line extending from said cleaning solution tank to said pump, a fluid flow line extending from said pump to said cleaning tool, said method comprising the following steps:

(a) generating a vacuum with said vacuum fan;

(b) providing a valve means operatively connecting said fluid flow line and said vacuum flow path with means for switchably connecting said fluid flow line with said vacuum flow path means;

(c) using said vacuum to cause cleaning solution to flow from said cleaning solution tank to said pump via said cleaning solution line to thereby prime said pump with said cleaning solution; and (d) closing said valve means after said pump is primed whereby delivering said cleaning solution to said cleaning tool from said tank via said fluid flow line.

40. A method in accordance with claim 39 wherein the step of closing scod valve means after said pump is primed, includes pumping said cleaning solution through said fluid flow line past said valve means automatically closing said valve means.

41. A method for providing a cleaning solution to a cleaning tool on a wet vacuum/extractor which includes a vacuum fan for generating a vacuum, a cleaning solution tank, vacuum flow path defining means operably connecting said tool to said vacuum fan whereby said vacuum fan can generate said vacuum in said cleaning tool, a non-self-priming pump, a cleaning solution feed line extending from said cleaning solution tank to said pump, a fluid flow line extending from said pump to said cleaning tool, said method comprising the following steps:

(a) generating a vacuum with said vacuum fan;

(b) providing a first valve means for controlling the flow of fluid to said cleaning tool, a second valve means operatively connecting said fluid flow line and said vacuum flow path means for switchably connecting said fluid flow line with said vacuum flow path means;

(c) opening said second valve means to operatively connect said fluid flow line with said vacuum flow path means;

(d) using said vacuum to cause cleaning solution to flow from said cleaning solution tank to said pump via said cleaning solution line to thereby prime said pump with said cleaning solution;

(e) closing said second valve means after said pump is primed;

(f) unlocking said first valve means; and (g) pumping said cleaning solution to said cleaning tool from said pump via said fluid flow line.

42. A method in accordance with claim 41 wherein generating a vacuum with said vacuum fan automatically opens said second valve means.

43. A method in accordance with claim 42 wherein pumping said cleaning solution to said cleaning tool through said fluid flow line automatically closes said second valve means.

44. A method in accordance with claim 43 wherein said second valve means is manually opened to operably connect said fluid flow line with said vacuum flow path defining means.

45. A method in accordance with claim 44 wherein said manually opened second valve means has a bias means for biasing said second valve means to a closed position.

46. A method for priming a non-self-priming pump on a wet vacuum/extractor which includes a vacuum fan for generating a vacuum, a cleaning solution tank, a cleaning tool, vacuum flow path defining means operably connecting said tool to said vacuum fan whereby said vacuum fan can generate said vacuum in said cleaning tool, a non-self-priming pump, a cleaning solution feed line extending from said cleaning solution tank to said pump, a fluid flow line extending from said pump to said cleaning tool, said method comprising the following steps:

(a) generating a vacuum with said vacuum fan (b) providing a first valve means for controlling the flow of fluid to said cleaning tool, a second valve means operatively connecting said fluid flow line and said vacuum flow path means for switchably connecting said fluid flow line with said vacuum flow path means;

(c) using said vacuum to cause cleaning solution to flow from said cleaning solution tank to said pump via said cleaning solution line to thereby prime said pump with said cleaning solution; and (d) closing said second valve means after said pump is primed whereby unlocking said first valve means, said cleaning solution is pumped to said cleaning tool from said pump via said fluid flow line.

47. A method in accordance with claim 46 wherein said cleaning solution pumped through said fluid flow line past said second valve means automatically closes said second valve means.

* * * * *

UNITED STATES PATENT AND TRADEMARK OFFICE

CERTIFICATE OF CORRECTION

PATENT NO. : 5,287,590
DATED : February 22, 1994
INVENTOR(S) : Yonkers et al.

It is certified that error appears in the above-indentified patent and that said Letters Patent is hereby corrected as shown below:

Column 2, line 39
"life" should be --line--;

Column 8, line 15
"non-self-printing" should be --non-self-priming--;

Column 9, Claim 34, line 17
After "whereby" insert --the cleaning solution--;

Column 9, line 57
"scod valve" should be --said valve--;

Signed and Sealed this

Seventeenth Day of January, 1995

Bruce Lehman

*Attest:*

BRUCE LEHMAN

*Attesting Officer*

*Commissioner of Patents and Trademarks*